United States Patent [19]

Ellis et al.

[11] Patent Number: 4,607,405

[45] Date of Patent: Aug. 26, 1986

[54] JET STREAM WATER BED

[76] Inventors: Linda N. Ellis; George Spector, both of 233 Broadway, Rm 3615, New York, N.Y. 10007

[21] Appl. No.: 766,985

[22] Filed: Aug. 19, 1985

[51] Int. Cl.[4] ..... A61G 7/04

[52] U.S. Cl. ..... 5/451; 5/450; 5/453; 128/66

[58] Field of Search ..... 5/174, 202, 400, 451, 5/452, 453, 454, 456, 455; 128/33, 64, 66; 4/538, 541, 542, 543, 544

[56] References Cited

U.S. PATENT DOCUMENTS

| | | | |
|---|---|---|---|
| 3,420,226 | 1/1969 | Berry, Jr. | 128/66 |
| 3,602,927 | 9/1971 | Wyss | 5/174 |
| 3,736,605 | 6/1973 | Klein, Jr. | 5/451 |
| 4,141,096 | 2/1979 | Hale et al. | 5/451 |
| 4,241,464 | 12/1980 | Buckwalter | 128/66 |
| 4,258,706 | 3/1981 | Shank | 128/33 |
| 4,297,755 | 11/1981 | Mollura | 5/451 |
| 4,346,489 | 8/1982 | McMullan | 5/451 |

FOREIGN PATENT DOCUMENTS

| | | | |
|---|---|---|---|
| 2115190 | 10/1972 | Fed. Rep. of Germany | 5/451 |
| 2601506 | 7/1977 | Fed. Rep. of Germany | 128/64 |
| 2550442 | 2/1985 | France | 5/453 |

OTHER PUBLICATIONS

*Floatation Sleep Industry,* Mar. 1985, p. 61, Resionic Corp. product advertisement.

*Primary Examiner*—John E. Murtagh
*Assistant Examiner*—Richard Chilcot

[57] ABSTRACT

A jet stream water bed is provided and consists of a plurality of flexible water tubes in a circular ring positioned within the water bed mattress to fluidly connect to a water pump so that when the pump is activated a person on the mattress can be massaged by jet streams of water coming from the ring of water tubes. In a modified form the upper portion of the mattress contains an air chamber with one way flap valves therein so that top ends of the water tubes can extend into the air chamber to increase pulsating action of the jet streams of water within the mattress.

4 Claims, 6 Drawing Figures

JET STREAM WATER BED

BACKGROUND OF THE INVENTION

The instant invention relates generally to water beds and more specifically it relates to a jet stream water bed.

Numerous water beds have been provided in prior art that are adapted to perform various tasks. For example, U.S. Pat. Nos. 773,828; 3,757,362 and 3,872,526 all are illustrative of such prior art. While these units may be suitable for the particular purpose to which they address, they would not be as suitable for the purposes of the present invention as heretofore described.

SUMMARY OF THE INVENTION

A principle object of the present invention is to provide a jet stream water bed that utilizes the pulsating action of jet streams of water within the water bed mattress so that a person on the mattress can be massaged by the jet streams of water.

Another object is to provide a jet stream water bed that has circular pattern water tubes within the mattress connected to water pumps that are controlled by control knobs so that all areas of the person on the mattress can be massaged by the jet streams of water.

An additional object is to provide a jet stream water bed that has the upper portion of the mattress containing an air chamber with one way flap valves therein to increase the pulsating action of the jet streams of water within the mattress.

A further object is to provide a jet stream water bed that is economical in cost to manufacture.

A still further object is to provide a jet stream water bed that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
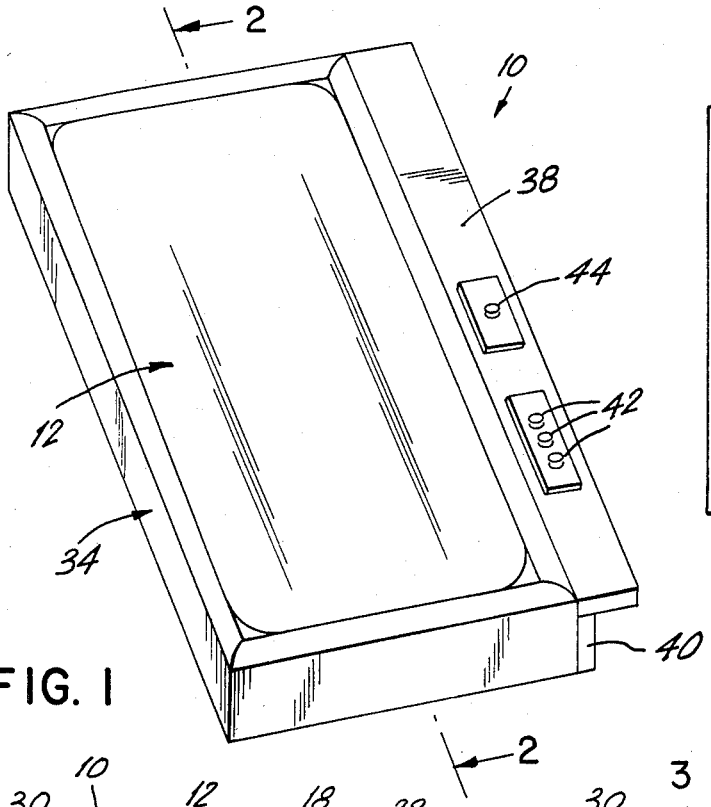
FIG. 1 is a perspective view of the invention.
Figure 2:
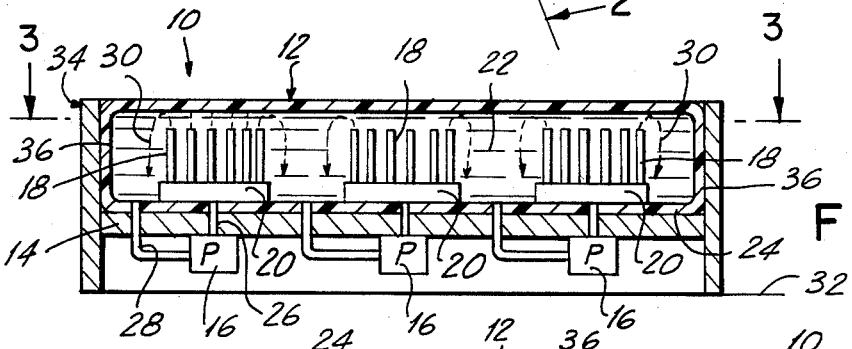
FIG. 2 is a cross sectional view taken along line 2—2 in FIG. 1.
Figure 3:
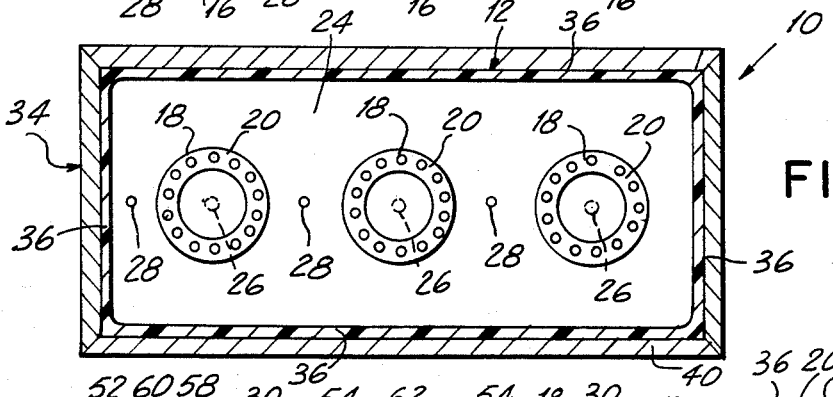
FIG. 3 is a cross sectional view taken along line 3—3 in FIG. 2.
Figure 5:
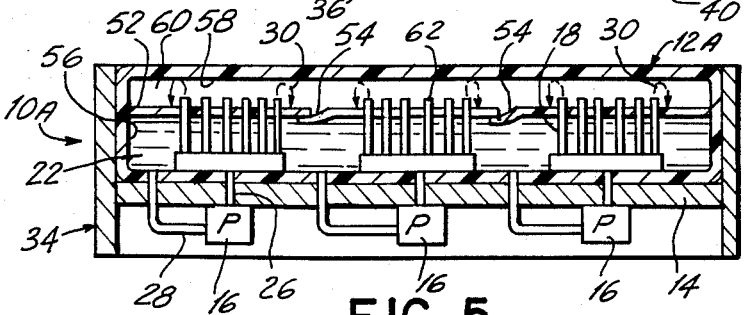
FIG. 5 is a cross sectional view similar to FIG. 2 showing a modification whereby upper portion of the mattress contains an air chamber with one way flap valves therein.

Turning now descriptively to the drawings, in which similar reference characters denote similar elements throughout the several views, FIGS. 1 through 3 illustrates a jet stream water bed 10 which includes a mattress 12, a rigid support member 14, water pumps 16 and a plurality of flexible water tubes 18 in circular rings 20.

The mattress 12 is a fluid-filled sealed container filled with water 22. The rigid support member 14 is positioned in contact with bottom 24 of the mattress 12.

Each water pump 16 has an inlet pipe 26 and an outlet pipe 28. Each pump 16 is positioned in contact with bottom of the support member 14 so that the inlet pipe 26 and the outlet pipe 28 will extend through the support member 14 and through the bottom 24 of the mattress 12.

Each ring 20 of water tubes 18 is positioned within the mattress 12 to fluidly connect to each inlet pipe 26 of each pump 16. When each pump 16 is activated, a person (not shown) on the mattress 12 can be massaged by jet streams of water 30 coming from each ring 20 of water tubes 18.

The rigid support member 14 is an elevated platform extending along and in contact with the bottom 24 of the mattress 12 so that the mattress is elevated off a floor surface 32 with the pumps 16 properly positioned thereto.

The jet stream water bed 10 further includes a frame 34 for engaging side walls 36 of the mattress 12. A horizontally extending ledge 38 is coupled to one side 40 of the frame 34.

Figure 4:
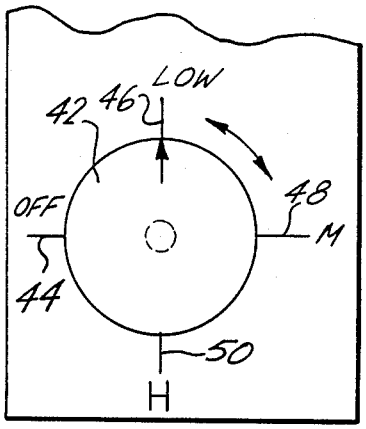
FIG. 4 is an enlarged top plan view of one of the control knobs.

Control knobs 42 and a control knob 44 are all housed within the ledge 38. The control knobs 42 are for operating the pumps 16 while control knob 44 is for operating a heater (not shown) within the mattress 12. Each knob 42, as best seen in FIG. 4, can be adjusted to a shut off position 44, a low position 46, a medium position 48 and a high position 50. This will reduce and increase voltage supplied to the pump 16 to change intensity of the jet streams 30.

Figure 6:
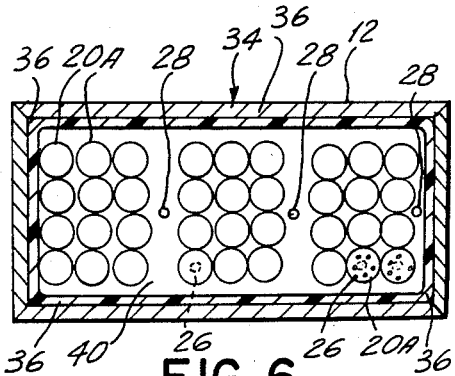
FIG. 6 is a cross sectional view similar to FIG. 3 showing another type of circular pattern that can be used for the water tubes.

In FIG. 3 each inlet pipe 26 of pump 16 is connected to one large ring 20. In FIG. 6 each inlet pipe 26 of each pump 16 is connected to a series of smaller rings 20A to increase the area in the mattress for the jet streams 30 so that more areas of a person's body can be massaged. The rings 20A shown in FIG. 6 is a prefered pattern to be used within the mattress 12.

A modified jet stream water bed 10A is shown. The mattress 12A includes a horizontal partition 52 that has one way flap valves 54 therein. The partition 52 forms forms a lower chamber 56 filled with water 22 and an upper chamber 58 filled with air 60. Top ends 62 of the water tubes 18 extend into the upper chamber 58 to increase pulsating action of the jet streams of water 30 within the upper chamber of the mattress 12A. The one way flap valves 54 allow water 50 exit back into the lower chamber 56.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A jet stream water bed comprising:

(a) a mattress being a fluid-filled sealed container;

(b) a rigid support member positioned in contact with bottom of said mattress;

(c) a water pump having an inlet pipe and an outlet pipe, said pump positioned in contact with bottom of said support member so that said inlet pipe and said outlet pipe will extend through said support member and through said bottom of said mattress; and (d) a plurality of flexible water tubes in a circular ring, said ring of water tubes positioned within said mattress to fluidly connect to said inlet pipe of said pump so that when said pump is activated a person on said mattress can be massaged by jet streams of water coming from said ring of water tubes.

2. A jet stream water bed as recited in claim 1, wherein said rigid support member comprises an elevated platform extending along and in contact with said bottom of said mattress so that said mattress is elevated off a floor surface with said pump properly positioned thereto.

3. A jet stream water bed as recited in claim 2, further comprising:

(a) a frame for engaging side walls of said mattress;

(b) a horizontally extending ledge coupled to one side of said frame; and (c) a control knob housed within said ledge for operating said pump, said knob can be adjusted to shut off, reduce and increase voltage supplied to said pump to change intensity of said jet streams.

4. A jet stream water bed as recited in claim 3, wherein said mattress further comprises a horizontal partition having a one way flap valve therein, said partition forms a lower chamber filled with water and an upper chamber filled with air with top ends of said water tubes extending into said upper chamber to increase pulsating action of said jet streams of water within said upper chamber of said mattress and said one way flap valve allowing water to exit back into said lower chamber.

* * * * *